US006422826B1

(12) United States Patent
Sharma et al.

(10) Patent No.: US 6,422,826 B1
(45) Date of Patent: Jul. 23, 2002

(54) FLUID PUMP AND METHOD

(75) Inventors: Ravi Sharma, Fairport, NY (US); Michael Debar, Berkeley, CA (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/585,941

(22) Filed: Jun. 2, 2000

(51) Int. Cl.[7] ..... F04B 19/24; F04F 11/00
(52) U.S. Cl. ..... 417/54; 417/65; 417/207
(58) Field of Search ..... 417/54, 65, 118, 417/207, 208; 346/140.1

(56) References Cited

U.S. PATENT DOCUMENTS 4,723,129 A * 2/1988 Endo et al. ..... 417/207
4,813,851 A * 3/1989 Chun et al. ..... 417/54
4,908,679 A 3/1990 Vora et al.
5,224,843 A 7/1993 Van Lintel et al.
5,300,444 A 4/1994 Hachisuka et al.
5,362,213 A 11/1994 Komatsu et al.
5,367,878 A * 11/1994 Muntz et al. ..... 417/207
5,375,979 A * 12/1994 Trah ..... 417/207
5,499,409 A 3/1996 St. Clair et al.
5,578,526 A 11/1996 Akram et al.
5,890,745 A 4/1999 Kovacs
5,907,791 A 5/1999 Cappuzzo et al.
6,071,081 A * 6/2000 Shiraishi ..... 417/52

* cited by examiner

*Primary Examiner*—Michael Koczo
(74) *Attorney, Agent, or Firm*—Walter S. Stevens

(57) ABSTRACT

A pump(10) for pumping various primary fluids includes a body(100) having a primary fluid channel(110) defined therein, and a primary fluid supply is coupled to the primary fluid channel to supply a primary fluid to the primary fluid channel. A mechanism(130/132) is provided for introducing a secondary fluid to an interface region of the primary fluid channel to thereby define a fluid interface between the primary fluid and the secondary dry fluid in the interface region. An energy delivery(150/160) device delivers energy to the interface region to create a thermal gradient along the fluid interface. The thermal gradient results in a surface tension gradient along the interface. The primary fluid will move to compensate for the surface tension gradient.

36 Claims, 9 Drawing Sheets

FLUID PUMP AND METHOD

FIELD OF THE INVENTION

The present invention relates generally to pumping devices, and more particularly to a fluid pump, such as a microscale fluid pump, using a temperature gradient across a multiple fluid interface to generate fluid motion.

BACKGROUND OF THE INVENTION

It is well known to utilize microscale fluid pumps in various applications. The term "microscale" as used herein refers to an apparatus or method using a minimum amount of fluid to effectively perform a function. Many microscale pumps incorporate thermal technology, whereby heat is used to move the fluid. For example in a bubble jet printer, the fluid in a channel is heated to a boil to create a bubble until the pressure ejects a droplet of the fluid out of a nozzle. The bubble then collapses as the heating element cools, and the resulting vacuum draws fluid from a reservoir to replace the fluid that was ejected from the channel. Thermal technology requires that the fluid to be pumped be resistant to heat, i.e. capable of being boiled without significant breakdown. Also, the need for a cooling period between ejecting successive droplets from a nozzle places speed limitations on thermal microscale pumps.

Piezoelectric microscale pumps, such as that disclosed in U.S. Pat. No. 5,224,843, have a piezoelectric crystal in the fluid channel that flexes when an electric current flows through it to force a drop of fluid out of a nozzle. Piezoelectric technology is faster and provides more control over the fluid movement as compared to thermal technology. Also, because the fluid to be pumped is not heated significantly, the fluid can be selected based on its relevant properties rather than its ability to withstand high temperatures. However, piezoelectric microscale pumps are complex and thus expensive to manufacture. U.S. Pat. Nos. 5,362,213 and 5,499,409 disclose microscale pumps having movable parts. Such pumps are relatively complex and required high maintenance.

Further, microscale fluid pumps find use in various other applications in which a high degree of control is required and high temperatures are to be avoided. For example, microscale fluid pumps can be used in biological heat-pipe type devices, devices which administer small doses of fluid into a larger stream of fluid, devices which pump various solutions that are unstable when boiled, devices which pump biological materials and other materials that must be maintained at a constant temperature, and other generic pumping applications. Accordingly, there is a need for a microscale fluid pump that is simple in construction and capable of pumping fluid quickly and accurately without boiling the fluid.

SUMMARY OF THE INVENTION

An object of the invention is to increase the control accuracy of microscale fluid pumps.

Another object of the invention is to simplify the construction of microscale fluid pumps.

Another object of the invention is to impart motion to fluid without the need for moving parts or boiling of the fluid.

Another object of the invention is to utilize standard CMOS processes to manufacture a microscale fluid pump.

Another object of the invention is to reduce the power required by microscale fluid pumps.

The invention achieves these and other objects through a first aspect of the invention which is a fluid pump comprising a body, a primary fluid channel defined in the body, a primary fluid supply coupled to the primary fluid channel to supply a primary fluid to the primary fluid channel, a mechanism for introducing a secondary fluid to an interface region of the primary fluid channel to thereby define a fluid interface between the primary fluid and the secondary fluid in the interface region, and an energy delivery device disposed proximate the interface region to selectively create a temperature gradient along the fluid interface to thereby impart motion to the primary fluid.

A second aspect of the invention is a method for pumping fluid comprising the steps of supplying a primary fluid to a primary fluid channel formed in a body, introducing a secondary fluid to an interface region of the primary fluid channel to define a fluid interface between the primary fluid and the secondary fluid in the interface region, and delivering energy to the interface region to create a temperature gradient along the fluid interface and impart motion to the primary fluid.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

Figure 1:
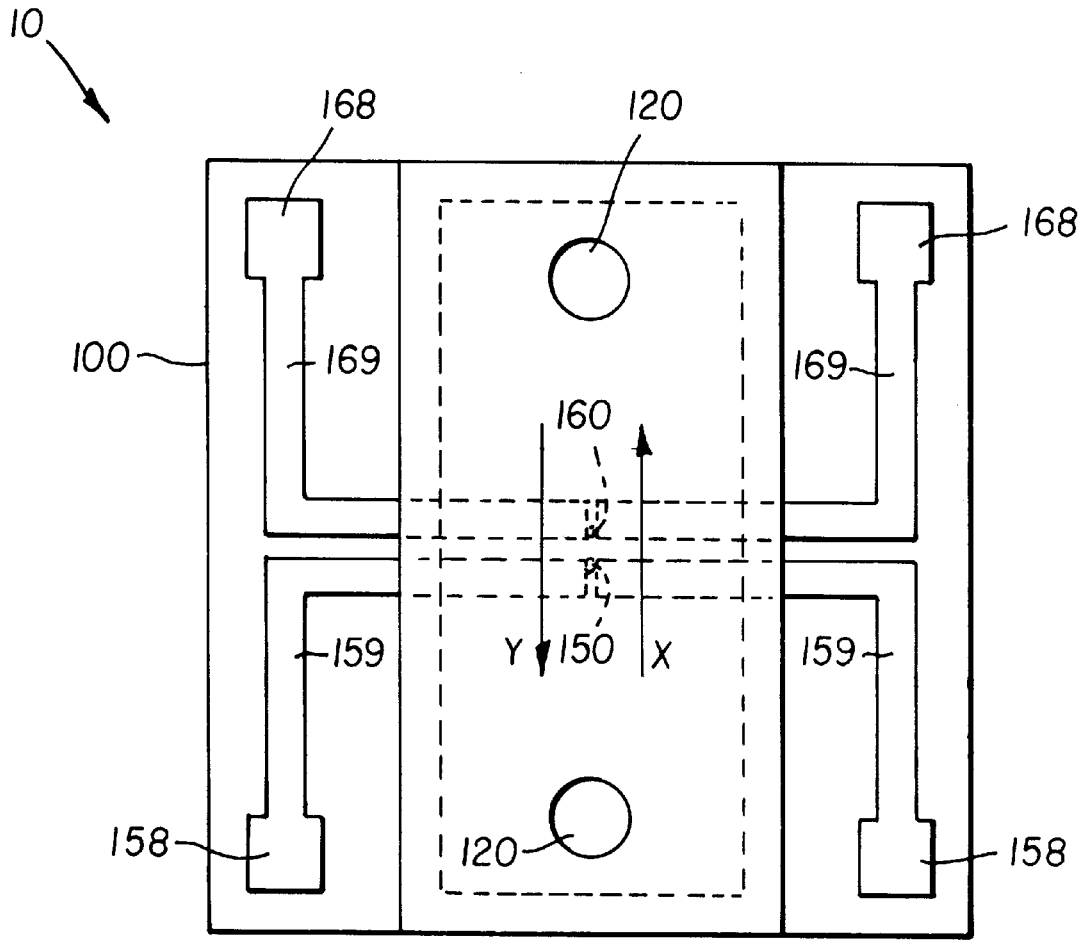
FIG. 1 is a top view of a pump in accordance with a first preferred embodiment the invention with portions rendered transparent.
Figure 2:
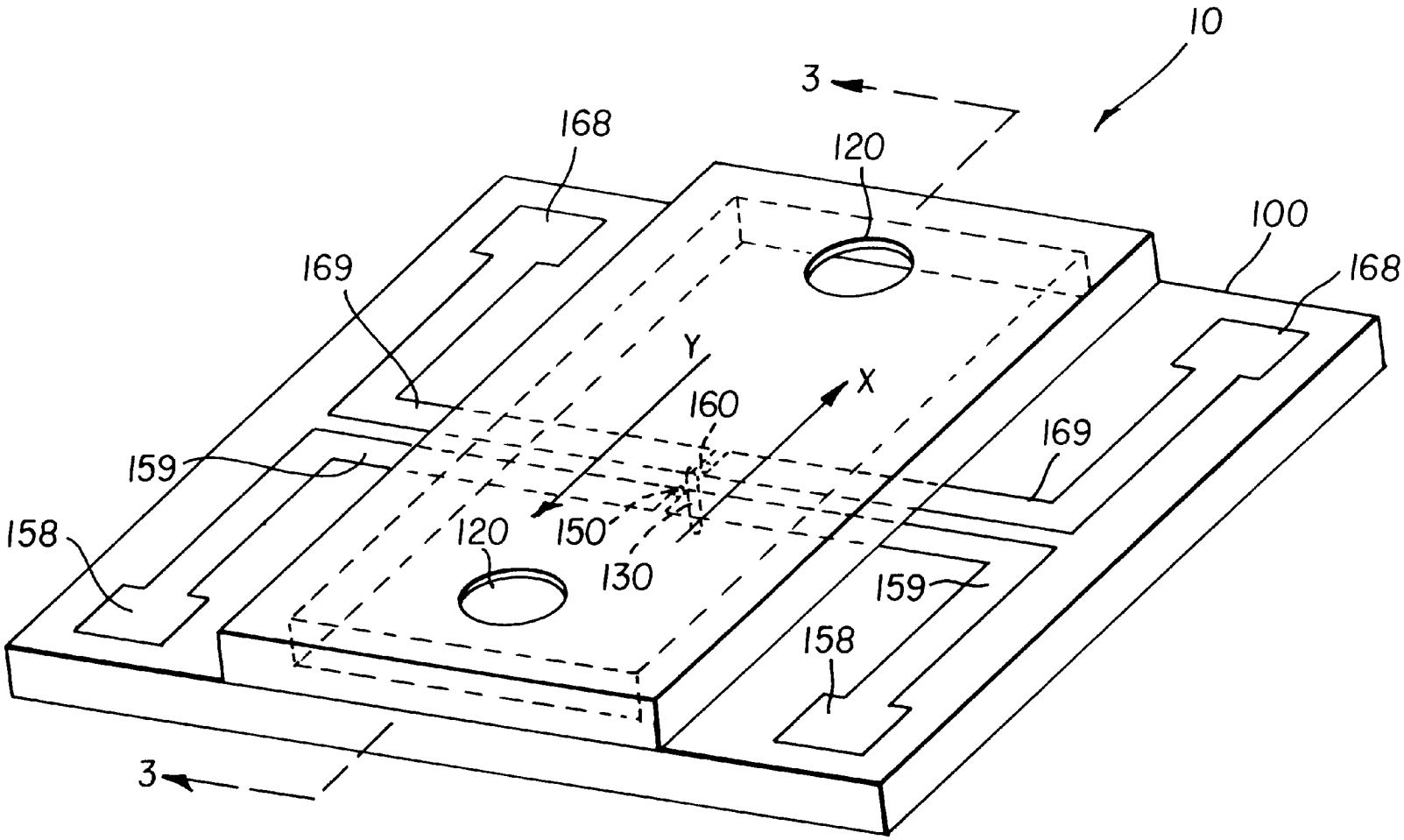
FIG. 2 is a perspective view of the pump of FIG. 1.

FIGS. 1–4 illustrate a first preferred embodiment of the invention. The preferred embodiment is formed in a silicon substrate using known CMOS fabrication techniques. However, the invention can be formed of various materials using various fabrication techniques. Microscale pump 10 includes silicon substrate 100 (serving as a pump body) having primary fluid channel 110 formed therein, through an etching process or the like. Primary fluid ports 120 communicate with primary fluid channel 110. One of primary fluid ports 120 can be coupled to supply 122 of primary fluid to be pumped (as illustrated schematically by the dotted line in FIG. 3) and the other of primary fluid ports 120 can be coupled to a nozzle or any other orifice, channel, or the like through which fluid is to be ejected or otherwise transported. The primary fluid can be a liquid, such as water, ink, or the like. As will become apparent below, microscale pump 10 can be operated in either a forward or reverse direction and thus primary fluid ports 120 are interchangeable with one another.

Figure 3:
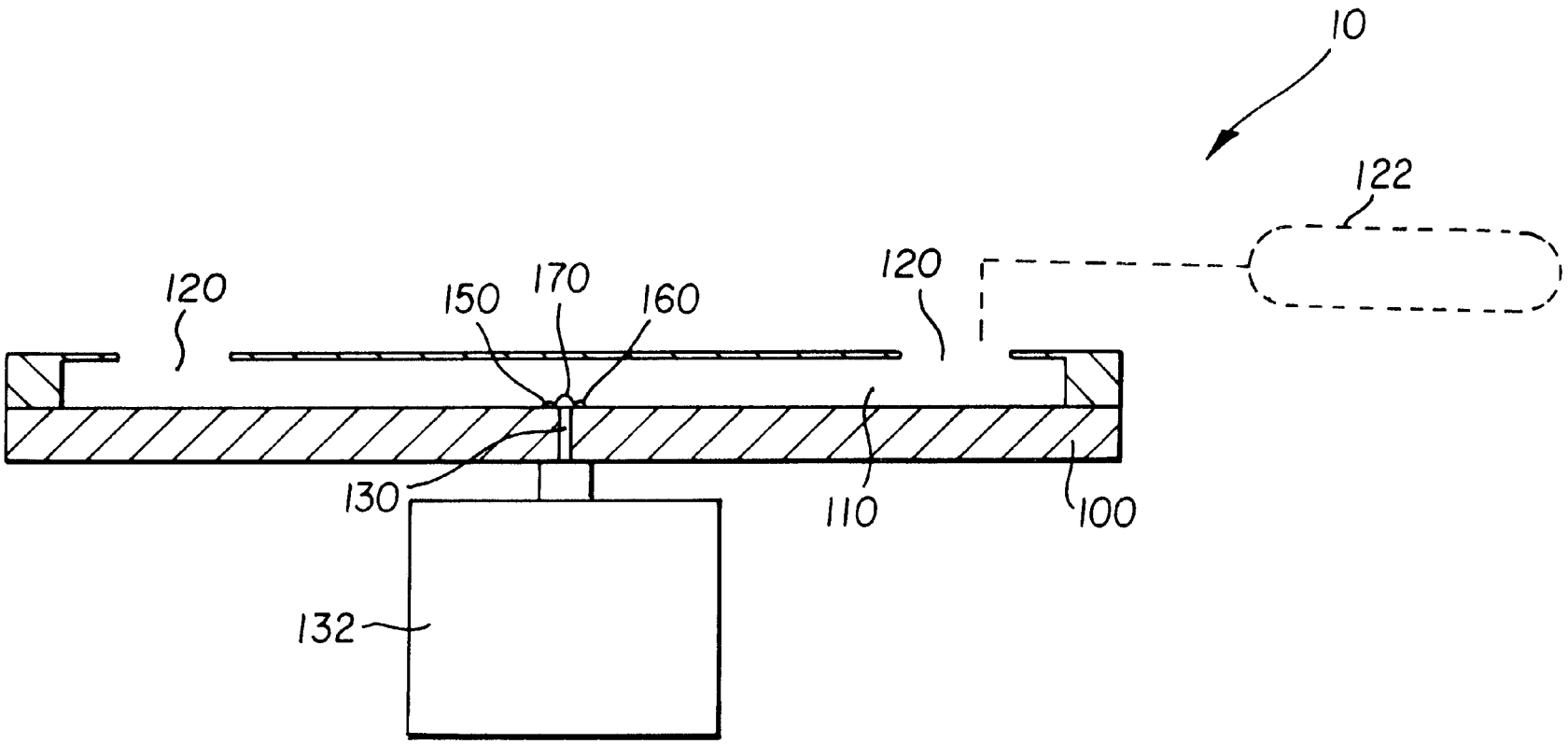
FIG. 3 is a sectional view taken along line 3—3 of FIG. 2.
Figure 4:
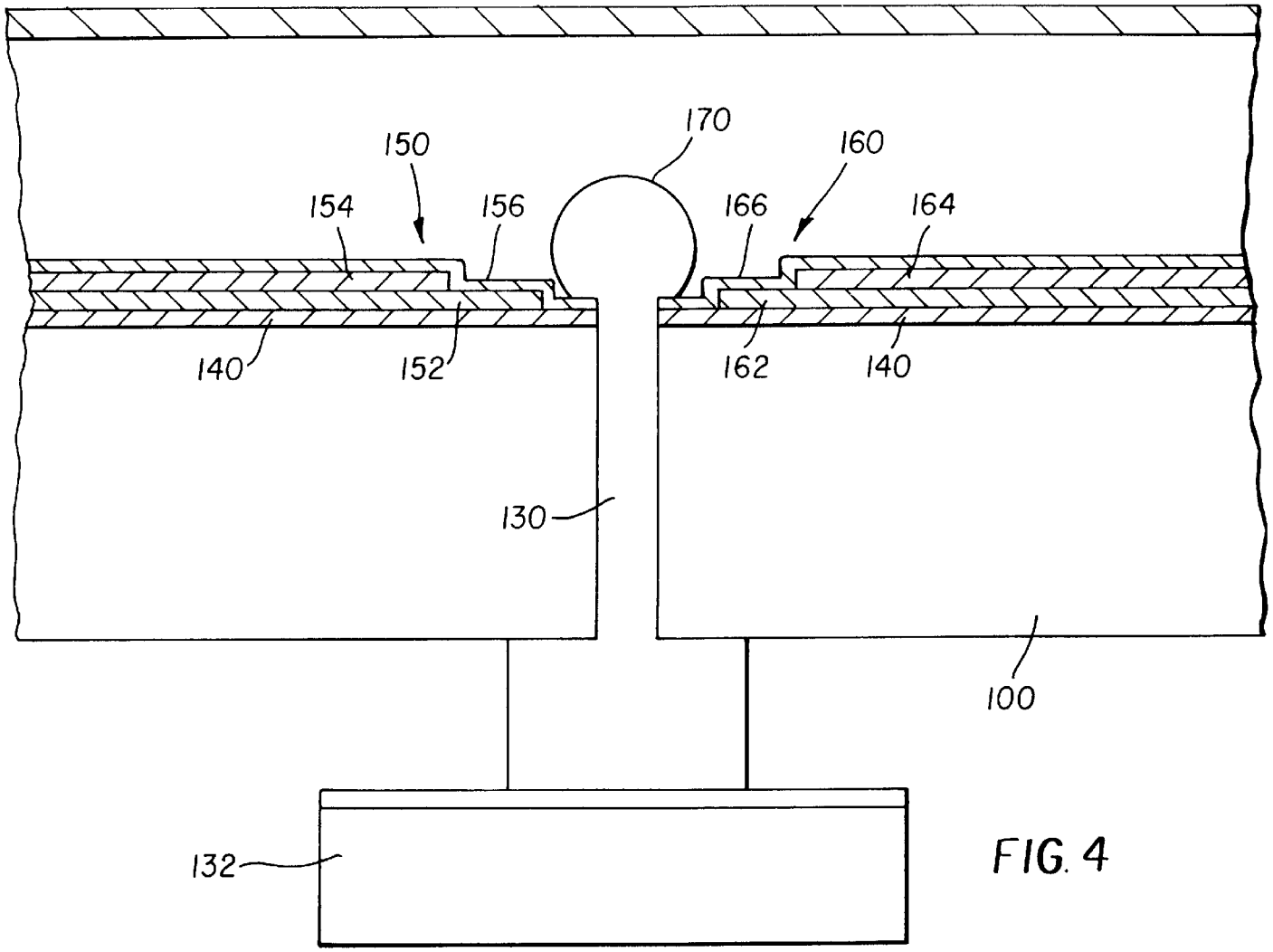
FIG. 4 is an enlarged view of portions of FIG. 3.

As best illustrated in FIGS. 3 and 4, secondary fluid channel 130 is formed in substrate 100 in communication with an interface region of primary fluid channel 110. Secondary fluid channel 130 is coupled to external supply 132 of a secondary fluid, such as a pressurized supply of nitrogen, air, argon, or carbon dioxide. Alternatively, the secondary fluid can be a liquid, such as oil or another unmixable liquid. Secondary fluid channel 130 and external supply 132 are operative to introduce the secondary fluid to the interface region of primary fluid channel 110. The secondary fluid is used to create a fluid interface with the primary fluid, as described in detail below, and preferably is not pumped by microscale pump 10.

As illustrated in FIG. 4 insulating layer 140, such as a thermal oxide layer, is formed on a surface by thermal oxidation of the silicon of substrate 100 in high temperature steam. Heating elements 150 and 160 are formed on insulating layer 140 respectively at opposing sides of the interface region of primary fluid channel 110. Heating elements 150 and 160 can be resistive elements and can each comprise doped polycrystalline layer 152/162 having aluminum layers 154/164 deposited thereon as conductors and oxide passivation layers 156/166 sputtered thereon to insulate the conductors from the fluid. As illustrated in FIG. 1, aluminum layer 154 is coupled to contact pads 158 by conductor 159 and aluminum layer 166 is coupled to contact pads 168 by conductor 169. Accordingly, electric power can be supplied to heating elements 150 and 160 to generate heat at the interface region.

During operation of microscale pump 10, a primary fluid to be pumped is supplied to primary fluid channel 110 through one of primary fluid ports 120. Further, a relatively small metered amount of a secondary fluid, such as a gas, is introduced into the interface region of primary fluid channel 110 through secondary fluid channel 130 to form bubble 170 of the secondary fluid as illustrated in FIG. 3. A fluid interface is thus defined between the primary fluid and the secondary fluid in the interface region of primary fluid channel 110. In this state, contact pads 158 and 168 can be coupled to a source of electric power that is controlled in a desired manner to selectively supply current to one of heating elements 150 or 160. For example, when electric current is supplied to heating element 150, through contact pads 158 and conductor 159, heating element 150 generates heat at one side of the interface region. Accordingly, a temperature gradient is created in the interface region along the interface between the primary fluid and the secondary fluid. Since the surface tension between two dissimilar fluids is dependent on the temperature at the interface of the fluids, a surface tension gradient is formed along the fluid interface. The primary fluid will naturally move in the direction of decreasing temperature, i.e. the direction indicated by arrow x in FIGS. 1 and 2, to compensate for the surface tension gradient. Accordingly, motion is imparted to the primary fluid in response to activation of heating element 150. Heating element 160 can be activated in a similar manner to move the primary fluid in the direction of arrow y. Further, heating elements 150 and 160 can be activated together or separately to varying degrees to precisely control the temperature gradient along the fluid interface and thus precisely control movement of the primary fluid.

Figure 5:
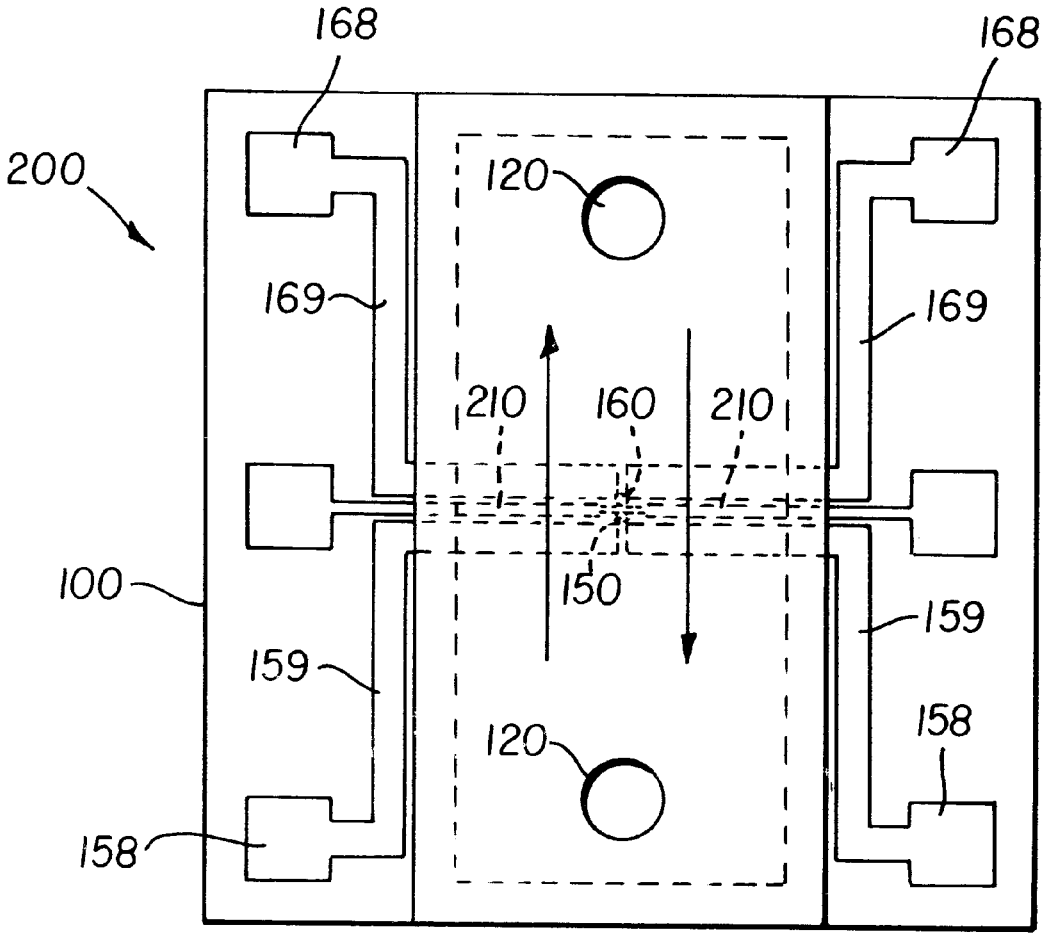
FIG. 5 is a top view of a pump in accordance with a second preferred embodiment of the invention with portions rendered transparent.
Figure 6:
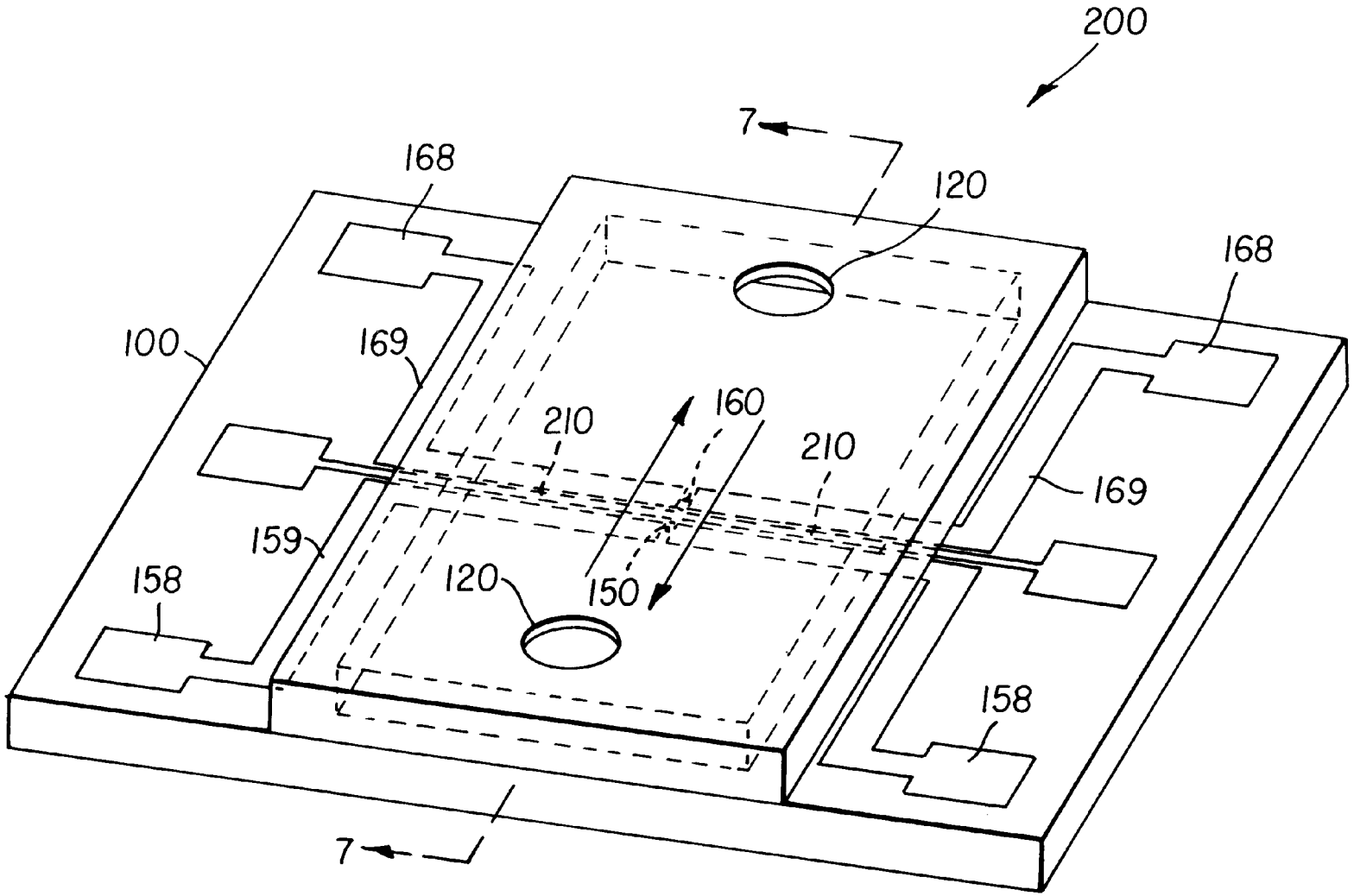
FIG. 6 is a perspective view of the pump of FIG. 5.
Figure 7:
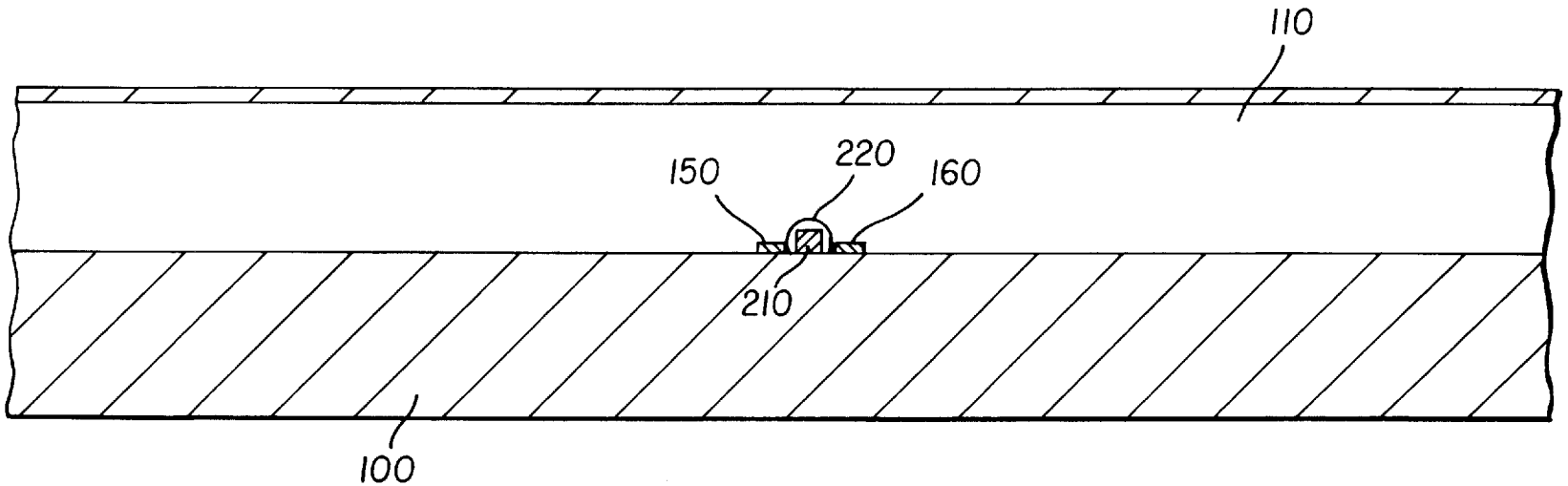
FIG. 7 is an enlarged sectional view taken along line 7—7 of FIG. 6.

FIGS. 5–7 illustrate a second preferred embodiment of the invention. Microscale pump 200 is similar to microscale pump 10 of the first preferred embodiment. However, microscale pump 200 does not have a secondary fluid channel for introducing a secondary fluid. In microscale pump 200, bubble 220 is formed, i.e. the secondary fluid is introduced, in-situ. In particular, a pair of electrodes 210 are provided proximate an interface region of primary fluid channel 110. Electrodes 210 are coupled to an external source of electric power. After an aqueous fluid is introduced into primary fluid channel 110 as the primary fluid, electrodes 210 can be energized, i.e. an electric potential can be placed across electrodes 210, to thereby dissociate the primary fluid into components of hydrogen and oxygen to form bubble 220 of hydrogen and oxygen in the interface region. Other than the in situ formation of bubble 220, the structure and operation of microscale pump 200 is similar to that of microscale pump 10 and like reference numerals are used to label similar parts in FIGS. 5–7. Various types of primary fluid can be dissociated or otherwise transformed to form the secondary fluid.

Figure 8:
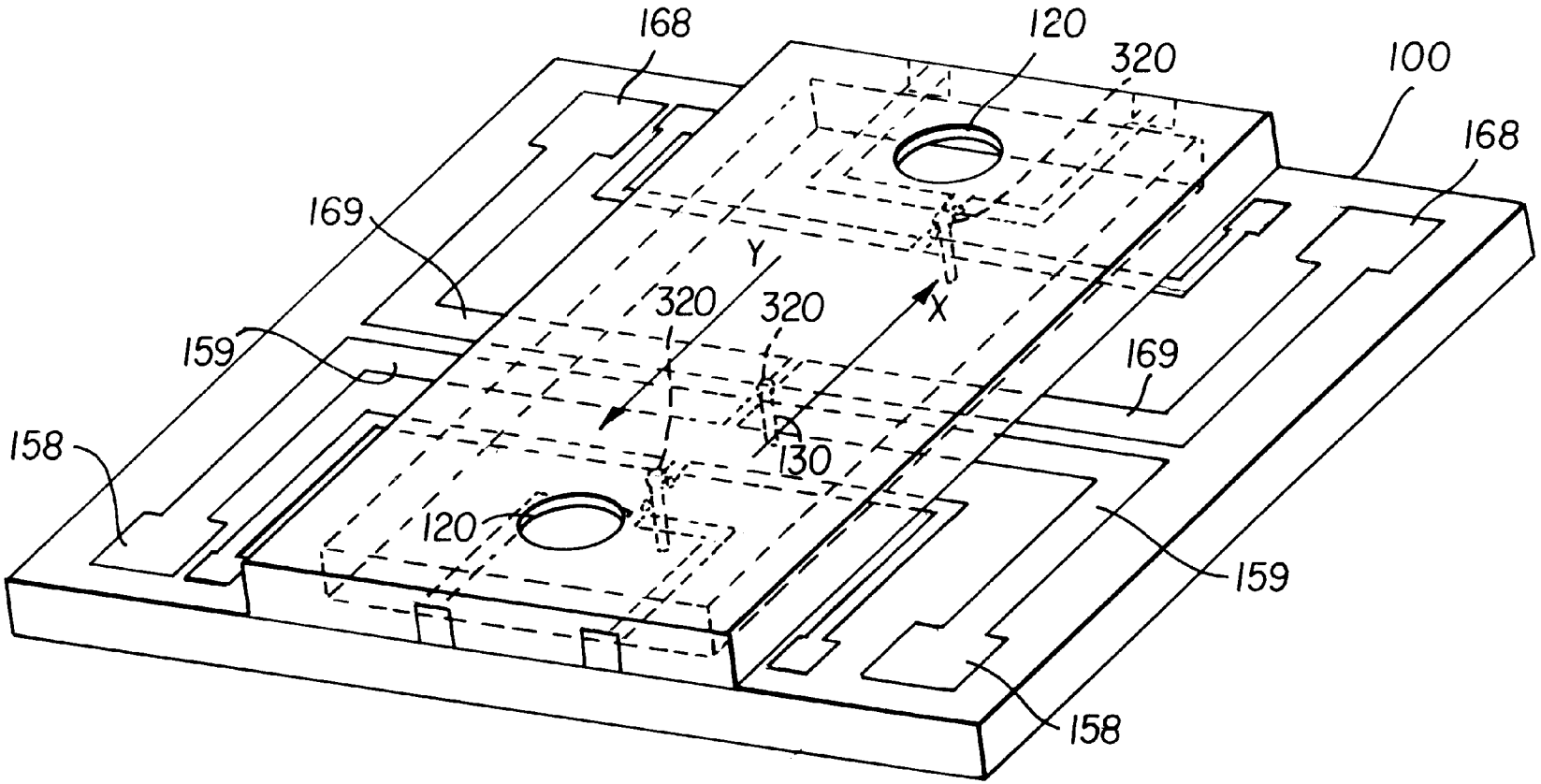
FIG. 8 is a perspective view of a pump in accordance with a third preferred embodiment of the invention.

FIG. 8 illustrates a third preferred embodiment of the invention. Microscale pump 300 is similar to microscale pump 10 of the first preferred embodiment and microscale pump 200 of the second preferred embodiment. However, microscale pump 300 includes plural interface regions each having a mechanism for introducing a secondary fluid, i.e. producing bubble 320. The mechanism for introducing each bubble 320 of secondary fluid can be similar to that of the first preferred embodiment, i.e. external, or the second preferred ;embodiment, i.e. in-situ. Microscale pump 300 can create a temperature gradient along one or more fluid interfaces and thus a surface tension gradient along one or more interfaces between the primary fluid and the secondary fluid. Each fluid interface can be used to impart motion to the primary fluid in the manner described above. Because the fluid interfaces are in serial relationship with each other along the flow direction, the pressure or flow volume can be increased as compared to a pump having only one interface region. Further, a parallel arrangement of fluid interfaces will accomplish similar results.

Figure 9:
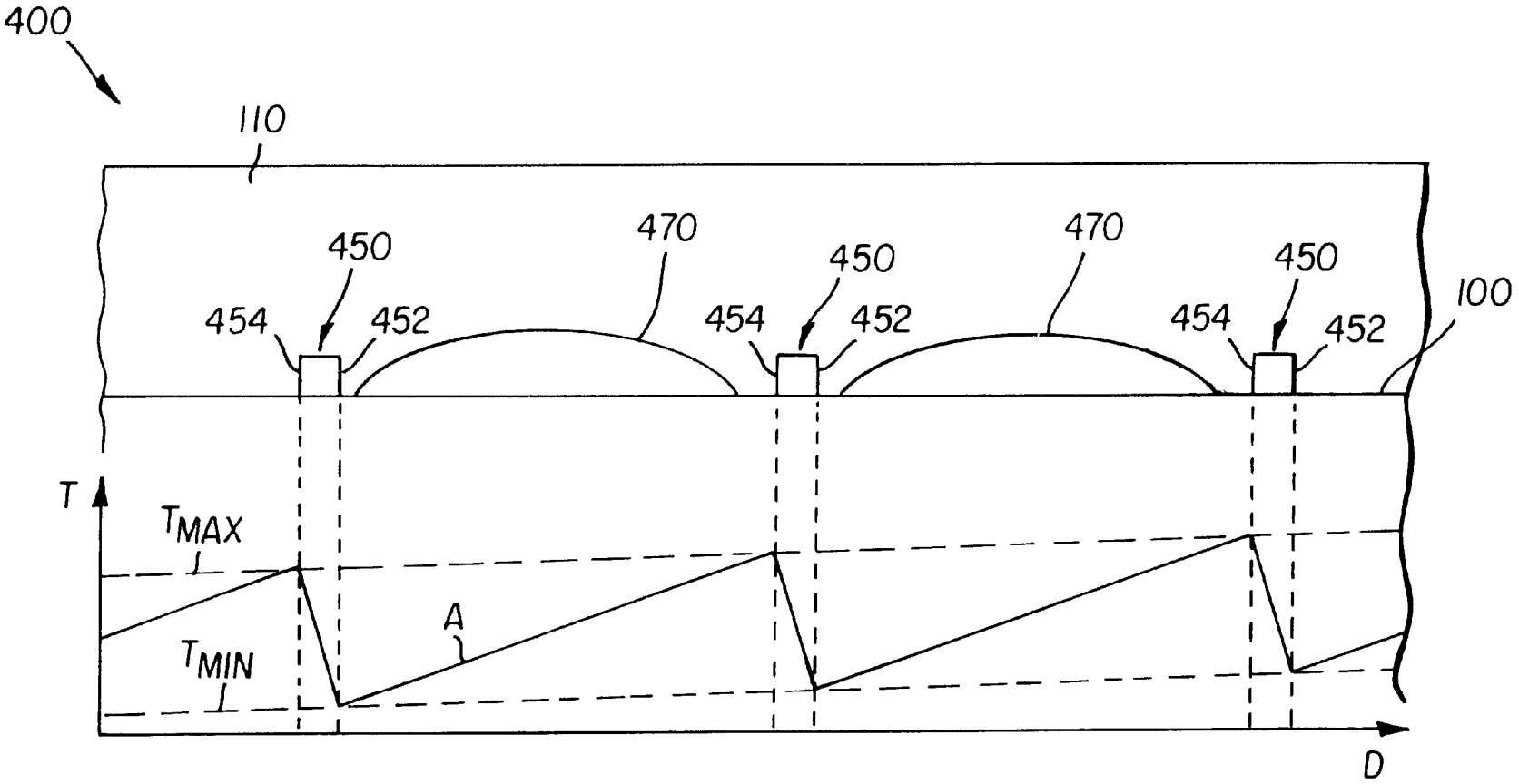
FIG. 9. is a schematic diagram of a portion of a fourth preferred embodiment of the invention and a corresponding graph illustrating the temperature gradients.

FIG. 9 illustrates a fourth preferred embodiment of the invention. Microscale pump 400 is similar to microscale pump 300 of FIG. 8. However, the energy delivery devices are in the form of heat pumps 450 formed on substrate 100, such as Peltier coolers, each having cold side 452 and hot side 454. The interface region or regions can be defined between cold side 452 and hot side 454 of adjacent heat pumps 450 as indicated by bubbles 470. Because one side of the interface region is cooled and the other side is heated, the temperature gradient across the interface region can be increased as illustrated by curve A. Therefore, the fluid velocity of the primary fluid, which is proportional to the temperature gradient, can be increased.

In particular, curve A represents the temperature T in the primary fluid as a function of distance D through primary fluid channel 110. The temperature fluctuates between a minimum temperature Tmin of cold side 452 and a maximum temperature Tmax of hot side 454. Of course, Tmax and Tmin increase slightly with distance D through primary fluid channel 110. Adverse effects of the large temperature gradient across each heat pump 450 can be avoided by positioning the secondary fluid introducing means, which can be similar to any of the embodiments disclosed above, at a central location between adjacent heat pumps 450 to form bubbles 470 at the central locations. Other aspects of the fourth preferred embodiment can be similar to the other embodiments disclosed above and thus are not discussed in detail.

The secondary fluid can be introduced in any manner. As noted above, the bubble of secondary fluid can be formed in situ or through an external fluid supply. Further, the in situ bubble can be formed through a chemical reaction, through electrical dissociation of molecules, through heat, or in any other manner. In fact, a single pump may incorporate plural types of mechanisms for introducing the bubbles. The primary fluid can be any fluid that is to be pumped, such as a liquid or gas. The secondary fluid can be any fluid that presents an interface with the primary fluid having the desired surface tension and other properties. The secondary fluid can be selected based on the primary fluid, the pump structure, and other considerations of each application.

The pump can be constructed using standard CMOS techniques or any other techniques. The pump can be formed using a silicon substrate as a body or using any other type of body in which the necessary channels can be formed. The substrate can be comprised of one or plural pieces. For example, a bottom piece can include the electronics and a top piece can define the channels and ports. The pump can be of any size and the components thereof can have various relative dimensions. Accordingly, the pump can be a microscale pump or a larger or smaller device. The heating elements can be any type of energy delivery device, such as resistive heaters, radiation heaters, convection heaters, chemical reaction heaters (endothermic or exothermic), nuclear reaction heaters, or the like. The pump can be controlled in any appropriate manner, such as with a microprocessor based device having a predetermined program. The heating elements can be activated to provide a desired temperature gradient in any manner. For example, the heating elements can be controlled by adjusting the current therethrough or by intermittent activation in a predetermined manner. There can be one heating element or plural heating elements. The various layers and coatings can be formed using any process and of any materials. The pump can be applied to pumping of various fluids, such as ink in a print head, biological materials, medicaments, or any other fluids.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

10 Microscale Pump
100 Substrate
110 Primary Fluid Supply
120 Fluid Port
122 Primary Fluid Supply
130 Secondary Fluid Channel
132 Secondary Fluid Supply
140 Insulating Layer
150/160 Heating Elements
152/162 Polycrystalline Layer
154/164 Aluminum Layer
156/166 Oxide Layers
158/168 Contact Pad
159/169 Conductor
170 Bubble
200 Microscale Pump
210 Electrodes
220 Bubble
300 Microscale Pump
320 Bubble
400 Microscale Pump
450 Heat Pump
452 Cold Side
454 Hot Side
470 Bubble

What is claimed is:

1. A fluid pump comprising:

a body including a substrate that comprises a semiconductor material;

a primary fluid channel defined in said body;

a primary fluid supply coupled to said primary fluid channel to supply a primary fluid to said primary fluid channel;

a mechanism for introducing a secondary fluid to an interface region of said primary fluid channel to thereby define a fluid interface between the primary fluid and the secondary fluid in said interface region; and an energy delivery device disposed proximate said interface region to selectively create a temperature gradient along the fluid interface to thereby impart motion to the primary fluid.

2. A pump as recited in claim 1, wherein said substrate comprises silicon.

3. A pump as recited in claim 1, wherein said energy delivery device comprises a first heating element disposed proximate a first side of said interface region.

4. A pump as recited in claim 3, wherein said energy delivery device further comprises a second heating element disposed proximate a second side of said interface region, said second side of said interface region being in opposition to said first side of said interface region.

5. A pump as recited in claim 1, wherein said mechanism for introducing the secondary fluid comprises a secondary fluid channel defined in said body in communication with said primary fluid channel at said interface region and a secondary fluid supply coupled to said secondary fluid channel.

6. A pump as recited in claim 1, wherein said mechanism for introducing the secondary fluid comprises a mechanism for forming the secondary fluid in situ from the primary fluid inside said primary fluid channel.

7. A pump as recited in claim 6, wherein said mechanism for forming the secondary fluid comprises a pair of electrodes disposed proximate said interface region.

8. A pump as recited in claim 1, wherein there are a plurality of said interface regions, said means for introducing being associated with each of said interface regions.

9. A pump as recited in claim 1, wherein said primary fluid channel is formed in said body above said silicon substrate and CMOS circuits are formed in said substrate.

10. A pump comprising:

a body;

a primary fluid channel defined in said body;

a primary fluid supply coupled to said primary fluid channel to supply a primary fluid to said primary fluid channel;

a mechanism for introducing a secondary fluid to an interface region of said primary fluid channel to thereby define a fluid interface between the primary fluid and the secondary fluid in said interface region; and an energy delivery device disposed proximate said interface region to selectively create a temperature gradient along the fluid interface to thereby impart motion to the primary fluid, wherein said energy delivery device comprises at least one heat pump.

11. A pump as recited in claim 10, wherein said at least one heat pump is a Peltier cooler.

12. A pump as recited in claim 1, wherein the primary fluid is a liquid.

13. A pump as recited in claim 1, wherein the primary fluid is water.

14. A pump as recited in claims 12, wherein the secondary fluid is an immiscible liquid with respect to the primary fluid.

15. A pump as recited in claim 12, wherein the secondary fluid is a gas.

16. A pump as recited in claim 15, wherein the secondary fluid is nitrogen.

17. A method for pumping fluid comprising the steps of:

supplying a primary fluid to a primary fluid channel formed in a body including a substrate that comprises a semiconductor material;

introducing a secondary fluid to an interface region of the primary fluid channel to define a fluid interface between the primary fluid and the secondary fluid in the interface region; and delivering energy to the interface region to create a temperature gradient along the fluid interface and impart motion to the primary fluid.

18. A method as recited in claim 17, wherein said delivering step comprises delivering energy to a first heating element disposed proximate a first side of the interface region.

19. A method as recited in claim 18, wherein said delivering step further comprises delivering energy to a second heating element disposed proximate a second side of the interface region, the second side of the interface region being in opposition to the first side of the interface region.

20. A method as recited in claim 17, wherein said introducing step comprises introducing the secondary fluid from a secondary fluid supply through a secondary fluid channel defined in the body in communication with the primary fluid channel at the interface region.

21. A method as recited in claim 17, wherein said introducing step comprises forming the secondary fluid in situ from the primary fluid inside the primary fluid channel.

22. A method as recited in claim 21, wherein said forming step comprises charging a pair of electrodes disposed proximate said interface region to dissociate components of the primary fluid.

23. A method as recited in claim 17, wherein there are a plurality of the interface regions and said introducing step comprises introducing the secondary fluid to each of the interface regions.

24. A method pumping fluid comprising the steps of:

a primary fluid to a primary fluid channel formed in a body;

introducing a secondary fluid to an interface region of the primary fluid channel to define a fluid interface between the primary fluid and the secondary fluid in the interface region; and delivering energy to the interface region to create a temperature gradient along the fluid interface and impart motion to the primary fluid, wherein said delivering step comprises delivering energy with at least one heat pump.

25. A method as recited in claim 24, wherein said at least one heat pump is a Peltier cooler.

26. A method as recited in claim 24 wherein said body includes a substrate formed of a semiconductor material.

27. A method as recited in claim 26 wherein said substrate is formed of silicon that includes CMOS devices.

28. A method as recited in claim 17 wherein said substrate is formed of silicon that includes CMOS devices.

29. A method as recited in claim 17 and wherein motion is imparted to the primary fluid without boiling the primary fluid.

30. A fluid pump comprising:

a body including a substrate that comprises a semiconductor material;

a primary fluid channel defined in said body;

a primary fluid supply coupled to said primary fluid channel for supplying a primary fluid to said primary fluid channel;

means for introducing a secondary fluid to an interface region of said primary fluid channel to thereby define a fluid interface between the primary fluid and the secondary fluid in said interface region; and energy delivery means for selectively creating a temperature gradient along the fluid interface to thereby impart motion to the primary fluid.

31. A pump as recited in claim 30 wherein the primary fluid is ink.

32. A pump as recited in claim 1 wherein the primary fluid is ink.

33. A pump as recited in claim 10 wherein the primary fluid is ink.

34. A method as recited in claim 17 wherein the primary fluid is ink.

35. A method as recited in claim 24 wherein the primary fluid is ink.

36. A method as recited in claim 27 wherein said primary fluid is ink.

* * * * *